US010370235B2

(12) United States Patent
Pellaud

(10) Patent No.: US 10,370,235 B2
(45) Date of Patent: Aug. 6, 2019

(54) BEVERAGE DISPENSING DEVICE COMPRISING AT LEAST TWO POD OR CAPSULE RECEIVING MEANS

(71) Applicant: Anheuser-Busch InBev S.A., Brussels (BE)

(72) Inventor: Jerome Pellaud, New Rochelle, NY (US)

(73) Assignee: Anheuser-Busch InBev S.A., Brussels (BE)

( * ) Notice: Subject to any disclaimer, the term of this patent is extended or adjusted under 35 U.S.C. 154(b) by 4 days.

(21) Appl. No.: 15/514,472

(22) PCT Filed: Sep. 25, 2015

(86) PCT No.: PCT/EP2015/072141
§ 371 (c)(1),
(2) Date: Mar. 24, 2017

(87) PCT Pub. No.: WO2016/046382
PCT Pub. Date: Mar. 31, 2016

(65) Prior Publication Data

US 2017/0240401 A1 Aug. 24, 2017

(30) Foreign Application Priority Data

Sep. 26, 2014 (EP) ..... 14186712

(51) Int. Cl.
*B67D 1/00* (2006.01)
*B67D 1/12* (2006.01)

(52) U.S. Cl.
CPC ..... *B67D 1/0027* (2013.01); *B67D 1/0016* (2013.01); *B67D 1/0018* (2013.01);
(Continued)

(58) Field of Classification Search
CPC .. B67D 1/0027; B67D 1/0018; B67D 1/0051; B67D 1/0078; B67D 1/1277;
(Continued)

(56) References Cited

U.S. PATENT DOCUMENTS 3,240,395 A * 3/1966 Carver ..... B67D 1/0021 222/129.1
4,528,226 A * 7/1985 Sweeny ..... A61K 9/70 261/DIG. 88

(Continued)

FOREIGN PATENT DOCUMENTS

EP 0 479 113 4/1992
EP 1 120 377 8/2001

(Continued)

*Primary Examiner* — Frederick C Nicolas
(74) *Attorney, Agent, or Firm* — Levy & Grandinetti

(57) ABSTRACT

A beverage dispensing device has a housing with a beverage unit with a liquid inlet and a beverage outlet. The beverage unit has a receiving receptacle for receiving at least two ingredient containers containing a unit dose of an ingredient of the beverage to be dispensed. The beverage unit also has a liquid line in fluid communication with a base liquid source, with the contents of the ingredient containers, when correctly installed in the device, and with the beverage outlet. The liquid line is split into two side lines at a point A, downstream the liquid inlet. Both side lines join in fluid communication at a point B, downstream point A and upstream the beverage outlet, at least one of the ingredient containers in liquid communication with the liquid line at a point M1 downstream point A and upstream point B.

9 Claims, 4 Drawing Sheets

(52) U.S. Cl.
CPC ..... *B67D 1/0021* (2013.01); *B67D 1/0051* (2013.01); *B67D 1/0078* (2013.01); *B67D 1/1277* (2013.01); *B67D 1/1284* (2013.01); *B67D 1/0043* (2013.01); *B67D 1/0057* (2013.01); *B67D 1/0058* (2013.01)

(58) Field of Classification Search
CPC .. B67D 1/1284; B67D 1/0021; B67D 1/0043; B67D 1/0058; B67D 1/0057; B67D 1/0016
See application file for complete search history.

(56) References Cited

U.S. PATENT DOCUMENTS 4,708,266 A * 11/1987 Rudick ..... B67D 1/0036 222/105
5,000,351 A * 3/1991 Rudick ..... B67D 1/0036 222/105
5,086,951 A * 2/1992 Nakayama ..... B67D 1/0021 222/129.1
7,757,896 B2 * 7/2010 Carpenter ..... B67D 1/0051 222/129.1
8,335,592 B2 * 12/2012 Deo ..... B67D 1/0005 222/52
9,315,370 B2 * 4/2016 Anselmino ..... F25D 23/126
2006/0249536 A1 * 11/2006 Hartman ..... B67D 1/0004 222/129.3
2007/0068966 A1 3/2007 Orzech et al.
2007/0131711 A1 * 6/2007 Minard ..... B65D 21/0223 222/105
2011/0125334 A1 5/2011 Deo et al.
2012/0230148 A1 9/2012 van Opstal et al.

FOREIGN PATENT DOCUMENTS

JP 02-52800 4/1990
WO WO 98/07122 2/1998
WO WO 2014/036127 3/2014

* cited by examiner

BEVERAGE DISPENSING DEVICE COMPRISING AT LEAST TWO POD OR CAPSULE RECEIVING MEANS

BACKGROUND OF THE INVENTION

The present invention relates to a beverage dispensing device for dispensing different types of beverages or beverage components, wherein at least one of the beverage ingredients is provided in a unit dose as a pod or capsule.

More in particular, the present invention relates to such a beverage dispensing device, wherein at least one of said beverages or beverage components is a malt based beverage or a malt based beverage component.

At present there is a trend to fancier kinds of beverages, wherein multiple beverage components or beverages are added to one another so to provide a consumer with a sensation adapted to his taste.

A goal of this invention is to provide a beverage dispensing device allowing consumers to prepare and serve such fancier beverages at home with one device with a small countertop footprint.

According to the state of the art all kinds of beverage dispensing devices exist which allow for the dispensing of different types of beverages or beverage components, such as beverage dispensing devices for dispensing different types of coffees and teas possibly mixed with milk, cream or sugar and so on.

Usually, the coffee or tea is made by passing hot water through coffee powder or tea leaves respectively.

Other beverage dispensing devices are for example intended for dispensing all kinds of juices or sodas.

It is clear that such beverage dispensing devices are of a complete other category than the type of beverage dispensing devices of interest in the present invention.

Indeed, the dispensing of different types of beverages or beverage components wherein at least one of the one of said beverages or beverage components is a malt based beverage or a malt based beverage component requires adapted equipment which is capable of coping with the specific needs related to malt based beverages or beverage components.

For example when dispensing a malt based beverage or beverage component, it is important to control foaming of the concerned beverage or beverage component.

Also, in beverage dispensing device having supply lines through which malt based beverages or beverage components are passed, a biofilm is slowly formed into the supply lines.

This biofilm reduces the quality for as far as the taste and smell is concerned of the dispensed malt based beverages or beverage components through the supply lines and must therefore be very regularly removed by a thorough cleaning of the supply lines.

Furthermore, the rate of dispensing, the pressures involved during dispensing and the volumes of liquid dispensed in beverage dispensing devices wherein at least one of the beverages or beverage components is a malt based beverage or a malt based beverage component are usually much higher than in the typical coffee machines or the like and require adapted equipment with increased capacity and strength.

It is understood that dispensing of such a beverage requires some skill and is time consuming.

It is also clear that depending on the person that is dispensing the beverage the volume ratio of the different beverage components dispensed can vary easily, resulting in a varying composition of the finally dispensed beverage, which is often not desired.

It is therefore an objective of this invention to overcome one or more of the above-mentioned drawbacks or possibly other non-mentioned drawbacks of the known beverage dispensing devices.

BRIEF SUMMARY OF THE INVENTION

To this aim, the present invention proposes a beverage dispensing device comprising at least a housing comprising a beverage unit with a liquid inlet and a beverage outlet, the beverage unit comprising:

- receiving means for receiving with at least two ingredient containers containing a unit dose of an ingredient of the beverage to be dispensed charged therein; and
- a liquid line in fluid communication with a base liquid source, with the content of the ingredient containers (when correctly installed in the device) and with the beverage outlet;

characterised in that the liquid line is split into two side lines at a point A, downstream the liquid inlet, both side lines joining in fluid communication at a point B, downstream point A and upstream the beverage outlet, at least one of the ingredient containers in liquid communication with the liquid line at a point M1 downstream point A and upstream point B.

Such a beverage dispensing device in accordance with the invention is very advantageous in that multiple beverages or beverage components provided in multiple ingredient containers can be dispensed through a single output line and this even within a single dispensing cycle.

In that way a beverage dispensing device is obtained by which a beverage comprising two or more ingredients of a consumers choice be dispensed through the single output line in one fluent movement, without the need for closing the dispensing valve after dispensing a first container containing a first beverage component to load the second container containing the second beverage component.

Preferably the beverage dispensing device is configured such that both ingredient containers are each in fluid communication with a different side line at points M1, respectively M2, located downstream point A and upstream point B.

According to a preferred embodiment the beverage dispensing device comprising a valve configured to control the liquid flow through both side lines of the liquid line.

The device according to the invention preferably comprises a control means steering a valve or series of valves for controlling the liquid flow through each pathway of the liquid line, allowing optimized mixing of the ingredients provided in the containers with the base liquid and of the mixed ingredient streams at the point where both pathways join one another upstream the single beverage outlet.

Such control means allow optimal control when the ingredient containers have different volumes or comprises concentrated ingredients having different mixing behaviour, solubility in the liquid base stream or different viscosity.

It is clear that when dispensing a malt based beverage and in particular a beer or mixture comprising beer, the dispensing temperature of the beer is preferably between 2 and 5° C. While the cooling capacity of the base liquid is limited due to potential freezing thereof, the volume content of the ingredient containers (which are usually provided in the dispensing device at room temperature or at a temperature of about 6-8° C. when stored in a fridge before use) should be kept as small as possible not to increase temperature of the base liquid.

In case one ingredient is needed in a smaller amount than another one or in case one ingredient can be concentrated to a larger extend than another one, it is therefore beneficial to load a container with such ingredient to a lesser extend than other pods or cartridges. This content of this pod or capsule with less volume load can be mixed efficiently in a smaller volume of base liquid than the content of container having a larger volume load.

In order to increase ease of use, the beverage dispensing device according to the present invention preferably comprises identification means for identification of the containers installed in the receiving means.

It is even more preferred that the dispensing device comprises a controller configured to control the valve in function of the identification of the containers installed in the receiving means.

To further increase ease of use and to automate the dispensing, the controller controlling the valve, preferably comprises a microprocessor wherein multiple dispensing cycle sequences are pre-stored, each dispensing cycle sequence comprising an active control of the valve during a single dispense cycle for dispensing one single beverage, whereby the flow rate through each side line of the liquid line varies during the a single dispense cycle.

Such a beverage dispensing device according to the invention can dispense a beverage comprising multiple beverages or beverage components in one single dispense cycle without the need of any intervention by a person, apart from loading the containers and starting the dispensing cycle.

The present invention also concerns a method of preparing and dispensing a beverage by means of a single beverage dispensing device, the method comprising:

selecting and providing a base liquid;

selecting and providing a first container comprising a unit dose of a first concentrated ingredient;

selecting and providing a second container comprising a unit dose of a second concentrated ingredient;

mixing the base liquid with said first and second concentrated ingredients within said single beverage dispensing device to obtain the prepared beverage; and dispensing said prepared beverage.

At least one of the ingredient containers preferably comprises at least one of: hop concentrates, fruit concentrates, sweeteners, bittering additives, concentrated spices, foaming promoters, concentrated malt-based liquids, concentrated fermented liquids, concentrated beer, colorants and or mixtures thereof.

The base liquid is preferably selected from: water, a malt-based beverage, a fermented beverage, beer and or mixtures thereof. The base liquid can either be non-carbonated (still) or carbonated Preferably the method comprises the step of varying the position of the valve to alter the flow rate of the base liquid in the side lines during mixing the ingredients with the base liquid.

BRIEF DESCRIPTION OF THE SEVERAL VIEWS OF THE DRAWING

With the intention of better showing the characteristics of the invention, hereafter, as example without any limitative character, some embodiments of a beverage dispensing device according to the invention are described, with reference to the accompanying drawings, wherein.

DETAILED DESCRIPTION OF THE INVENTION

Figure 1:
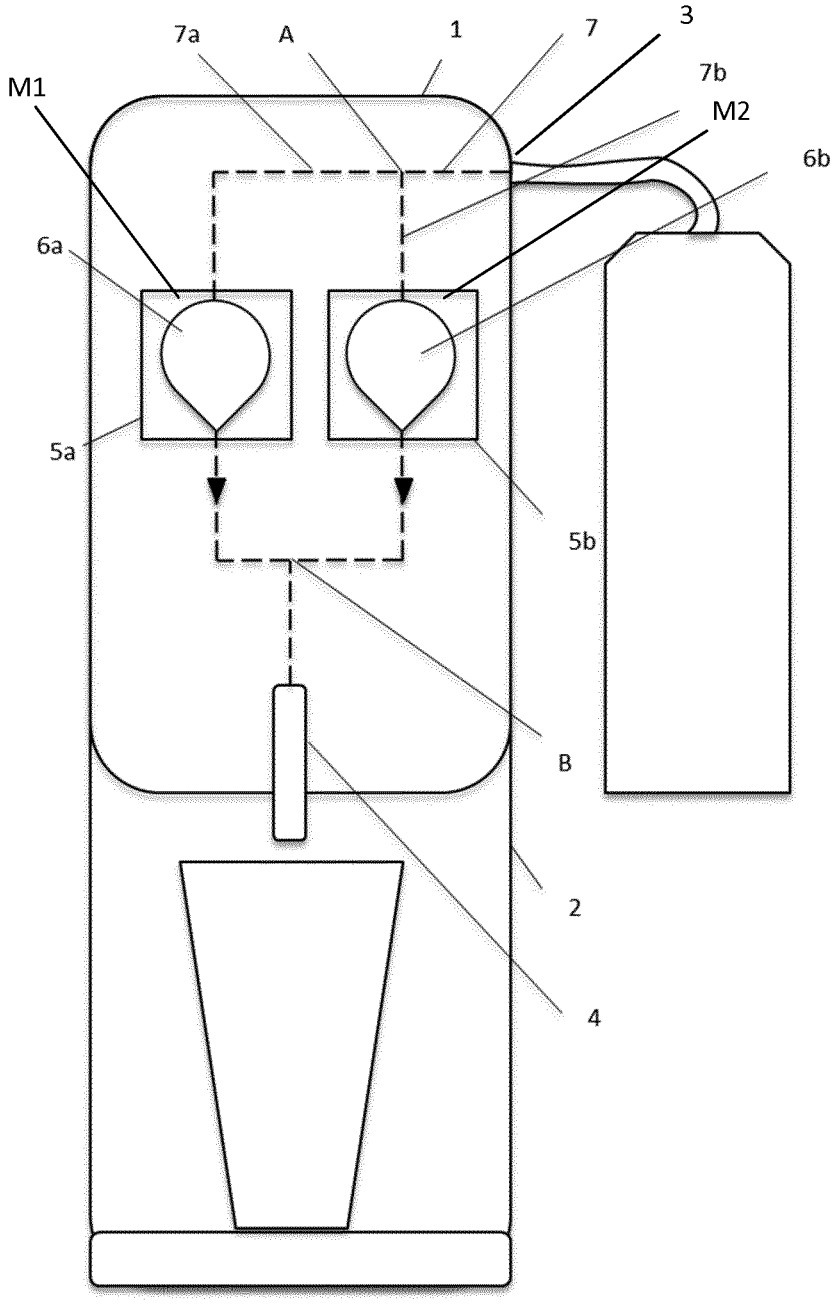
FIG. 1 is a schematically represents a first embodiment of a beverage dispensing device in accordance with the present invention.

The first embodiment of a beverage dispensing device (1) according to the invention, illustrated in FIG. 1, comprises a housing (2) comprising a beverage unit with a liquid inlet (3) and a beverage outlet (4), the beverage unit comprising:

receiving means (5*a*, 5*b*) for receiving at least two containers (6*a*, 6*b*) containing a unit dose of a (concentrated) ingredient of the beverage to be dispensed; and a liquid line (7) in fluid communication with a base liquid source (8), with the content of the pods or capsules (6*a*, 6*b*) when correctly installed in the device) and with the beverage outlet (4).

The containers comprise exactly one unit dose of beverage ingredient and are therefore suited for preparing exactly one beverage allowing maximal flexibility to customize a beverage to be dispensed. The containers are preferably of the kind generally addressed as pods or capsules and will be referred to as such in the description below.

In accordance with the invention, the liquid line (7) is split into two side lines (7*a*, 7*b*) at a point A, downstream the liquid inlet (3), both side lines (7*a*, 7*b*) joining in fluid communication at a point B, downstream point A and upstream the beverage outlet (4), at least one of the pods or capsules (6*a*, 6*b*) in liquid communication with the liquid line at a point M1 downstream point A and upstream point B.

In the embodiment of FIG. 1, a first pod or capsule (6*a*) is provided in the receiving means (5*a*) and in liquid communication with the side line (7*a*) of the liquid line at a point M1 downstream point A and upstream point B, whereas the second pod or capsule (6*b*) is provided in the receiving means (5*b*) in liquid communication with the side line (7*b*) of the liquid line at a point M2, downstream point A and upstream point B.

In this case, when introducing pods or cartridges in the device and dispensing a beverage, liquid from the base liquid source will flow through both side lines of the liquid line and mix with the content of both pods at different locations, resulting in two liquid streams comprising base liquid and a ingredient originating from the respective pod, joining at a point B, where both streams are mixed prior to leaving the dispensing device through the beverage outlet (4).

To allow good mixing of the streams of both side lines and to better control foaming, it is preferred that the point B where both side lines join in fluid communication, is positioned at least five cm upstream the beverage outlet. Additionally, the part of the liquid line extending from point B to the beverage outlet may comprise pressure reducing means such as a venturi for suppressing undesired foam creation.

Figure 2:
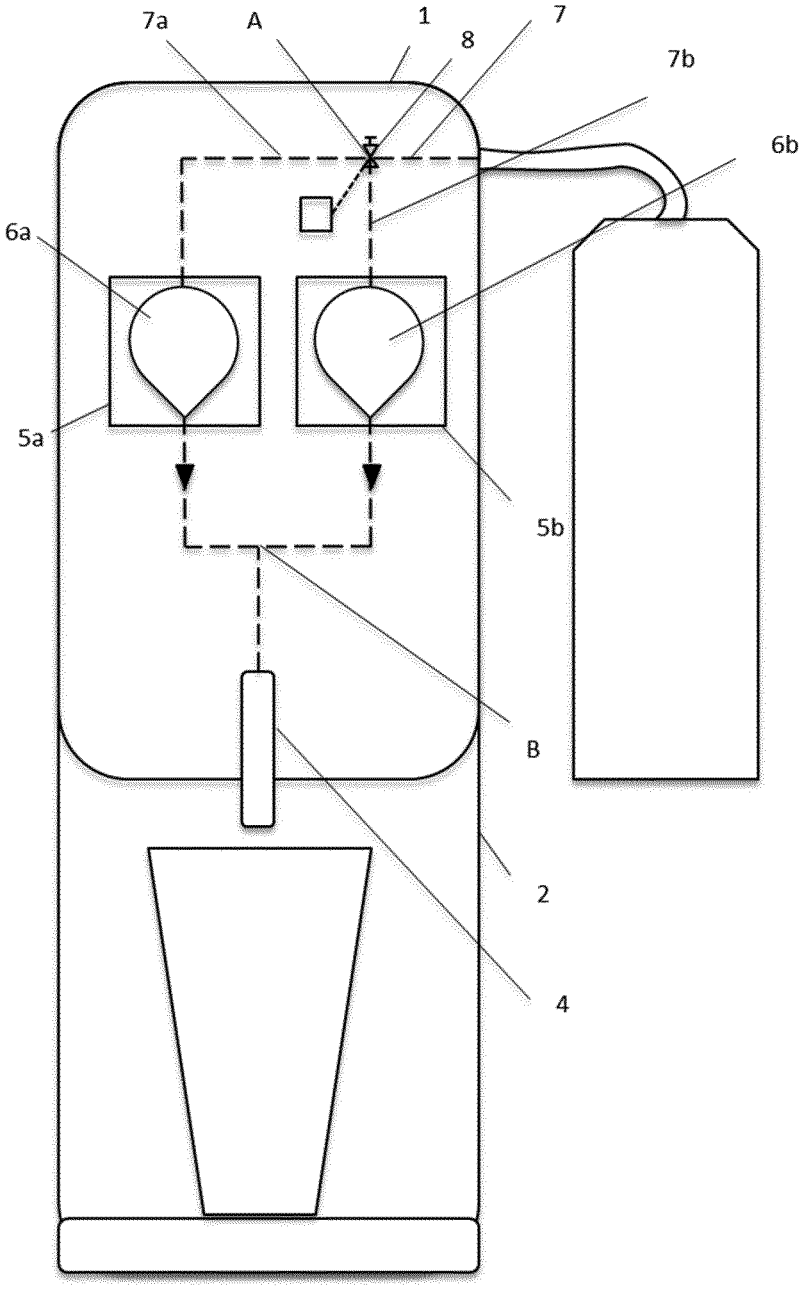
FIG. 2 is a schematically represents a first alternative embodiment of FIG. 1.

In the embodiment of FIG. 2, the flow of base liquid through each side line is regulated by means of a valve (8), allowing varying the flow rate of base liquid through each of the side lines (5*a*, 5*b*).

Such embodiment is particularly advantageous when the pods or capsules contain ingredients of a different nature having different mixing properties, such a different viscosity or different status (solid vs liquid).

Further this embodiment is advantageous for limiting the volume in each pod or capsule. When dispensing a malt-based or in particular beer based beverage, the dispensing temperature of the beverage is preferably between 2 and 5° C. In small dispensing devices for home use with a small countertop footprint, cooling of the beer to such extend in short periods is difficult if not impossible to achieve. Therefore it is known to pre-cool the base liquid to dispensing temperature or to a temperature slightly below dispensing temperature. Further cooling of the base liquid is often impossible due to ice formation.

In such case, when dispensing the beverage starting from a pre-cooled base liquid, the content of the pods or capsules needs to be as small as possible not to have a major impact on the temperature of the base liquid. Hence ingredients provided in the pods should be as concentrated as possible.

Some ingredients are easy to concentrate and can be concentrated with a high concentration factor without impact on the quality, other ingredients however are far more difficult to concentrate without use of quality.

As a result, some ingredients can be loaded in a pod in very low levels (highly concentrated), whilst others can be loaded in a pod in only slightly concentrated form, resulting in a relative large volume.

To improve mixing of the pods contents it is therefore beneficial to control the flow rate through the side lines (5*a*, 5*b*) such that a larger flow rate can be dedicated to the pod or capsule containing the largest load or the least soluble ingredient. As a result, good mixing of all ingredients can be achieved even with ingredients concentrated to a level wherein mixing becomes more difficult, thereby keeping the volume ratio between cooled base liquid and ingredients originating from the pods or capsules high and allowing dispensing the beverage at a desired temperature.

Figure 3:
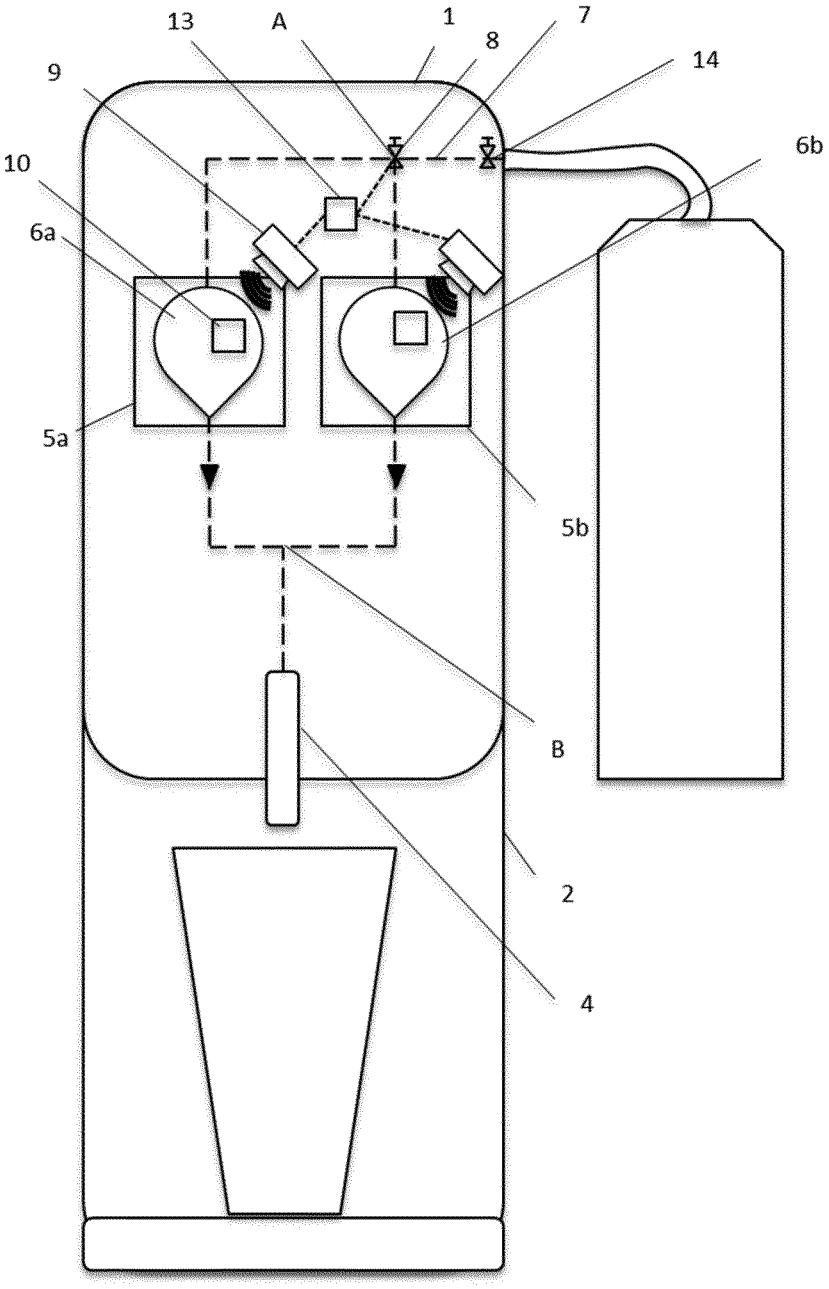
FIG. 3 is a schematically represents an second alternative embodiment of FIG. 1.

FIG. 3 illustrates a preferred embodiment comprising pod or capsule identification means (9) such as for example a bar-code scanner or RFID scanner (10) that allows identifying content related identity tags on the pods or capsules such as a bar code or RFID tag (11).

In this case the dispensing device also comprises a controller for controlling the valve or valve assembly and comprising a microprocessor and a memory.

The memory comprises a set of pre-loaded dispensing sequences for setting and varying the valve or valve assembly position during a dispensing cycle, whereby the microprocessor selects a sequence based on input received from the pod or capsule identification means.

The dispensing device according to the present invention and as depicted in FIG. 3 allows controlled dispensing of a large number of beverages using a liquid base source and two pods or capsules containing a unit dose of a specific ingredient.

To dispense a particular beverage, the user selects two pods or capsules of its choice and introduces these in the receiving means of the dispensing device. Upon loading the pods or capsules, the identification means identify the content of the pods and provides a signal to the microprocessor that, based on the received information, loads a steering sequence for the valve.

In its most simple form, the sequence will comprise a fixed setting for the valve for optimally split the flow of base liquid at the inlet over both side lines, whereby most of the base liquid will be guided to the side line in fluid communication with the pod or capsule comprising the most difficult ingredient to mix or solve or with the highest volume content.

Alternatively, when the first pod or capsule installed in the first receiving means (5*a*) contains an flavour ingredient and the second pod or capsule installed in the second receiving means comprises a foaming promoter, the controller will steer the valve or valve assembly such that at first base liquid is only flowing through the first side line, mixing the flavour ingredient therein before dispensing the mixture through the beverage outlet. After a given amount of beverage is dispensed, the controller will change the valve position to allow a liquid stream through both side lines, thereby mixing the foaming promoter in the base liquid first and later to mix the mixed foaming promoter with the mixture obtained in the first side line, to dispense a beverage having improved foaming properties, allowing dispensing a foam collar on the already dispensed beverage.

It is clear that the above dispensing sequence can also be provided for a second pod comprising for example a colorant, allowing dispensing beverages having one or more coloured layers.

The base liquid source can be any of water, a malt-based beverage, a fermented beverage, beer, a cider based beverage or cider and or mixtures thereof, the base liquid source can either be non-carbonated or carbonated.

The pods or capsules can comprise a solid or liquid ingredient, varying from hop concentrates, fruit concentrates, sweeteners, bittering additives, concentrated spices, foaming promoters, concentrated malt-based liquids, concentrated fermented liquids, concentrated beer, colorants and or mixtures thereof.

In a preferred embodiment of a beverage dispensing device 1 in accordance according to the invention, and as is also the case in the represented figures, the controlling means 13 comprise additionally flow rate controlling means 14 for controlling the flow rate through the liquid inlet.

This means 13 for controlling the flow rate through the liquid inlet can for example comprise choking means by which the section of the liquid line close to the inlet (upstream from point A) which is open for fluid flow can be reduced or increased so to set the desired flow rate.

In another embodiment however the flow rate controlling means can comprise pressurizing means, not illustrated in the figures, for setting a driving pressure by which an ingredient is driven out of its corresponding pod or capsule.

It has to be understood that the former example is only intended for illustrating the possibilities and that a beverage dispensing device 1 in accordance with the invention can be intended for dispensing only one beverage component or on the contrary multiple beverage components at the same time for forming one of the beverage layers.

Figure 4:
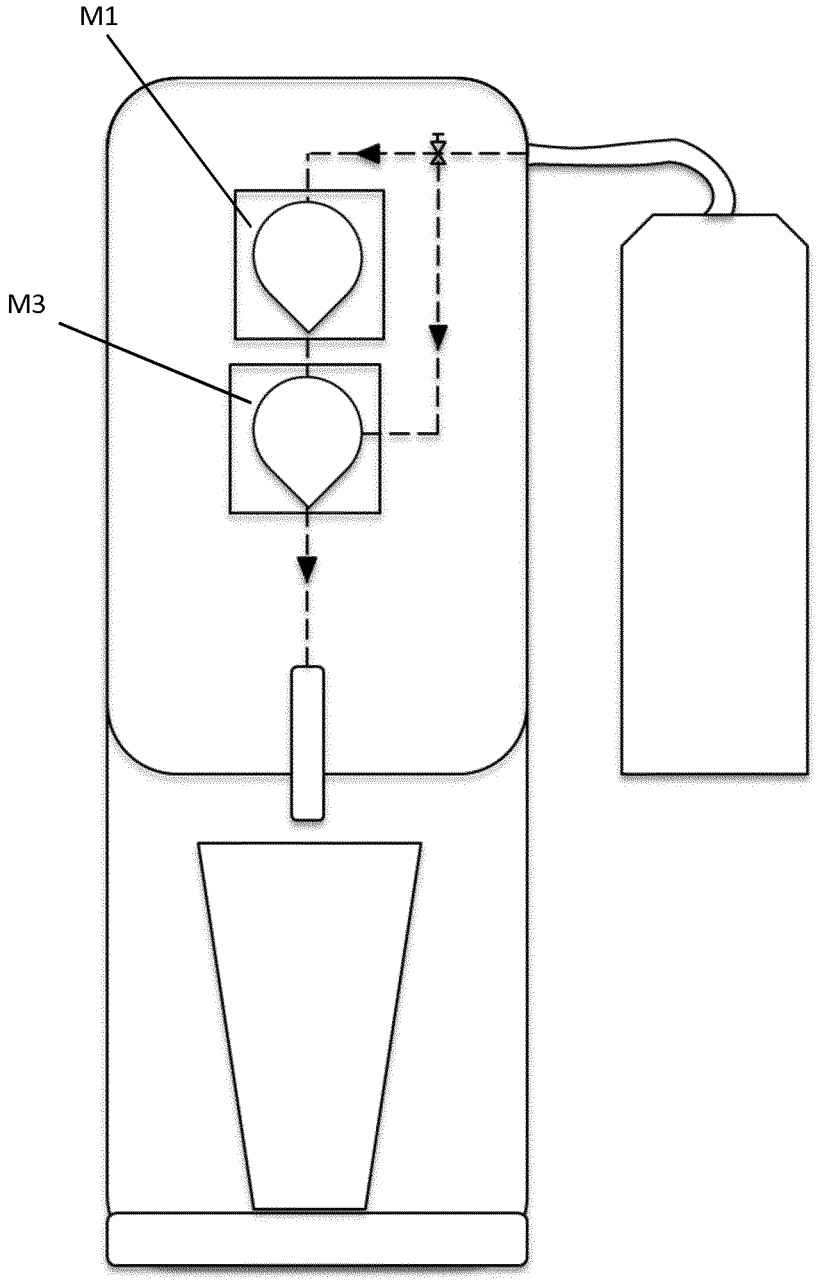
FIG. 4 schematically represents a third alternative embodiment of the invention.

In FIG. 4 an alternative embodiment of a dispensing device according to the present invention in shown, wherein a first pod or capsule receiving means is located such that the corresponding pod or capsule is in fluid communication at point M1, located downstream from point A and upstream from point B, whereas the second pod or capsule receiving means is located such that the corresponding pod or capsule is located at a point M3, at point B or downstream of point B.

Such embodiment is advantageous in that one of the pods or capsules receives a maximum of liquid (the total amount of liquid fed from the base liquid source for dispensing a single beverage) for mixing the content of that pod or capsule in the liquid of the beverage.

The invention claimed is:

1. A beverage dispensing device comprising at least a housing comprising a beverage unit with a liquid inlet and a beverage outlet, the beverage unit comprising:

a receiving means with at least two ingredient containers containing a unit dose of an ingredient of the beverage to be dispensed charged therein; and a liquid line in fluid communication with a base liquid source, with contents of the containers, when correctly installed in the device, and with the beverage outlet;

the liquid line is split into two side lines at a point A, downstream the liquid inlet, both side lines joining in fluid communication at a point B, downstream point A and upstream the beverage outlet, at least one of the ingredient containers in liquid communication with the liquid line at a point M1 downstream point A and upstream point B, and a valve to control liquid flow through said both side lines of the liquid line.

2. The beverage dispensing device according to claim 1, wherein said both containers are each in fluid communication with a different side line at points M1, respectively M2, located downstream point A and upstream point B.

3. The beverage dispensing device according to claim 1, comprising identification means for identification of the ingredient containers installed in the receiving means.

4. The beverage dispensing device according to claim 3, comprising a controller configured to control the valve in function of the identification of the ingredient containers installed in the receiving means.

5. The beverage dispensing device according to claim 4, wherein the controller controlling the valve comprises a microprocessor wherein multiple dispensing cycle sequences are pre-stored, each dispensing cycle sequence comprising an active control of the valve during a single dispense cycle for dispensing one single beverage, whereby flow rate through each side line of the liquid line varies during a single dispense cycle.

6. A method of preparing and dispensing a beverage by means of a single beverage dispensing device, the method comprising:

selecting and providing a base liquid;

selecting and providing a container comprising a unit dose of a first concentrated ingredient;

selecting and providing a container comprising a unit dose of a second concentrated ingredient;

mixing the base liquid with said first and second concentrated ingredients within said single beverage dispensing device to obtain the prepared beverage; and dispensing said prepared beverage, the single beverage dispensing device comprising a beverage unit with a liquid inlet and a beverage outlet, a receiving means for receiving at least two containers containing a unit dose of an ingredient of the beverage to be dispensed; and a liquid line in fluid communication with a base liquid source, with content of the ingredient containers, when correctly installed in the device and with the beverage outlet, the liquid line is split into two side lines at a point A, downstream the liquid inlet, both side lines joining in fluid communication at a point B, downstream point A and upstream the beverage outlet, at least one of ingredient containers in liquid communication with the liquid line at a point M1 downstream point A and upstream point B;

a valve to control liquid flow through said both side lines of the liquid line;

the method comprising the step of varying a position of the valve to alter flow rate of the base liquid in the side lines during mixing the ingredients with the base liquid.

7. The method according to claim 6, wherein at least one of the ingredient containers comprises at least one of: hop concentrates, fruit concentrates, sweeteners, bittering additives, concentrated spices, foaming promoters, concentrated malt-based liquids, concentrated fermented liquids, concentrated beer, colorants and or mixtures thereof.

8. The method according to claim 6, wherein the base liquid is selected from: water, a malt-based beverage, a fermented beverage, beer and or mixtures thereof.

9. The method according to claim 8, wherein the base liquid is carbonated.

* * * * *